US008438751B2

(12) United States Patent
Stolze

(10) Patent No.: US 8,438,751 B2
(45) Date of Patent: May 14, 2013

(54) DRYER WITH HEAT RECOVERY AND METHOD OF OPERATION THEREOF

(75) Inventor: Andreas Stolze, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 932 days.

(21) Appl. No.: 12/528,499

(22) PCT Filed: Feb. 25, 2008

(86) PCT No.: PCT/EP2008/052259

§ 371 (c)(1),
(2), (4) Date: Aug. 25, 2009

(87) PCT Pub. No.: WO2008/110449

PCT Pub. Date: Sep. 18, 2008

(65) Prior Publication Data

US 2011/0005096 A1 Jan. 13, 2011

(30) Foreign Application Priority Data

Mar. 12, 2007 (DE) ..... 10 2007 011 809

(51) Int. Cl.
*F26B 3/00* (2006.01)
*F26B 19/00* (2006.01)
*F26B 21/06* (2006.01)

(52) U.S. Cl.
USPC ..... 34/86; 34/467; 34/468; 34/513; 34/514; 34/73; 34/76

(58) Field of Classification Search ..... None
See application file for complete search history.

(56) References Cited

U.S. PATENT DOCUMENTS 4,154,003 A * 5/1979 Muller ..... 34/469
4,274,844 A * 6/1981 Baughman et al. ..... 55/355
4,326,344 A * 4/1982 Smith ..... 34/86

FOREIGN PATENT DOCUMENTS

DE 3000865 A1 7/1981
DE 3423240 A1 * 2/1985
DE 4023000 A1 * 1/1992
DE 4023000 C2 2/2003
DE 102005015653 A1 10/2006
EP 1541744 A1 6/2005
EP 1591579 A1 * 11/2005

* cited by examiner

*Primary Examiner* — Kenneth Rinehart
*Assistant Examiner* — Tavia Sullens
(74) *Attorney, Agent, or Firm* — James E. Howard; Andre Pallapies

(57) ABSTRACT

A dryer is provided having a drying chamber for items to be dried and a process air duct in which are located a heater for heating the process air, a blower for driving the process air from the heater through the drying chamber, and a heat exchanger arrangement. Via the heat exchanger arrangement, heat can be withdrawn from the process air flowing away from the drying chamber, and the process air flowing toward the heater can be fed to the heat exchanger. The process air duct is divided into a main duct and a secondary duct, the secondary duct having an evaporator in which condensate that was separated from the process air in the heat exchanger arrangement can be evaporated into the process air flowing therethrough and is connected to the exhaust opening.

11 Claims, 2 Drawing Sheets

DRYER WITH HEAT RECOVERY AND METHOD OF OPERATION THEREOF

BACKGROUND OF THE INVENTION

The invention relates to a dryer with a drying chamber for the items to be dried and a process air duct, in which are located a heater for the heating of process air and a blower for forcing the process air from the heater through the drying chamber and a heat exchanger arrangement, by means of which heat exchanger arrangement heat can be removed from the process air flowing from the drying chamber, and fed to the process air flowing to the heater, where the process air duct has an inlet air opening for drawing in process air from an environment of the dryer and an exhaust opening for expelling process air into the environment of the dryer.

The invention also relates to a method for operating such a dryer.

Such a dryer and such a method follow from DE 30 00 865 A1.

In general a tumble dryer is operated as an exhaust air dryer or a condensation dryer. An exhaust air dryer directs heated air once through the laundry to be dried and conveys this moisture-laden air through an exhaust air hose from the exhaust air dryer and out of the room in which it is set up. A condensation dryer, whose method of functioning relies on the condensing of the moisture evaporated out of the laundry by means of the warm process air, requires no exhaust air hose and enables the recovery of energy from the heated process air, for example through the use of a heat pump. Generally, though, it is necessary in such condensation dryers to collect the condensate accruing, and either pump it out or dispose of it through the manual emptying of collector tanks.

DE 40 23 000 C2 describes a tumble dryer with a heat pump circuit in which an inlet air opening is arranged in the process air duct between the condenser and the evaporator, which can be closed by means of a controllable sealing device.

In an exhaust air dryer, on the other hand, the air which is moisture-laden after passing through a laundry drum is generally directed out of the dryer. Compared with a condensation dryer, an exhaust air dryer can be more simply and thus more cheaply constructed. During its operation, an exhaust air dryer draws air from its environment, and uses this directly for drying purposes. As a rule, such ambient air is comparatively dry, with a relative humidity of significantly less than 100%, and can thus absorb a relatively large amount of moisture. By comparison, the circulating process air in a condensation dryer can as a rule only be dehumidified at 100% relative humidity at the lowest temperature obtaining in the process air circuit, which limits its capacity for absorbing moisture from the items to be dried and thus restricts the drying process to a certain extent.

Heat recovery is also possible in principle in an exhaust air dryer, though each such heat recovery implies a cooling of the exhaust air, whereby condensate can precipitate out of the exhaust air and has to be disposed of.

DE 30 00 865 A1 discloses a tumble dryer with heat recovery. The tumble dryer comprises a container to accommodate and move the laundry, into which is fed a heated supply air flow from a heating element, while the moist and warm air is conveyed as exhaust air via an outlet. A heat exchanger is arranged in the supply air flow upstream of the heating element, through which flows the humid exhaust air from the container. The tumble dryer is embodied as an exhaust air dryer.

In an exhaust air dryer with heat recovery, the ambient air (for example from 20° C. and 60% relative humidity; so-called supply air) as a rule flows into the heat exchanger surfaces of an air-to-air heat exchanger, where it is heated up accompanied by cooling of the warm process air emerging from the drying chamber. Depending on the cooling power or heat exchange respectively, condensate accrues, which is collected in a container or pumped out. In the first case emptying is necessary and in the second case connection to the waste-water network. The amount of condensate accruing is a gage of the heat energy given off in the heat exchanger and thus a measure of the improvement in energy efficiency.

BRIEF SUMMARY OF THE INVENTION

It is thus the object of the present invention to provide a dryer with a high level of energy efficiency, in which it is unnecessary to pump out accumulated condensate or collect it in a condensate collection container for subsequent disposal.

Generally, preferred embodiments of the inventive dryer correspond to embodiments of the inventive method, even if no detailed reference thereto follows.

The subject matter of the invention is thus a dryer with a drying chamber for the items to be dried and a process air duct, in which are located a heater for the heating of process air and a blower for forcing the process air from the heater through the drying chamber and a heat exchanger arrangement, by means of which heat exchanger arrangement heat can be removed from the process air flowing from the drying chamber and fed to the process air flowing to the heater, where the process air duct has an inlet air opening for the drawing-in of process air from an environment of the dryer and an exhaust opening for expelling process air into the environment of the dryer, characterized in that the process air duct between the drying chamber and the heat exchanger arrangement is split into a main duct and a secondary duct, where the main duct leads to the heat exchanger arrangement and the secondary duct bypasses the heat exchanger arrangement and contains an evaporator, in which condensate, which is separated out from the process air in the heat exchanger arrangement, can be evaporated into the through-flowing process air, and is connected with the exhaust opening.

The condensate separated out during drying in the dryer is a measure of the recirculation of heat energy in the drying process. On the basis of the energy balance of an exhaust air dryer without heat recirculation, the recirculation of heat can be measured and adjusted by means of corresponding design of the dryer such that a prescribed improvement in the energy balance is achieved, for example an improvement, on the basis of which a classification of the dryer into a desired, better energy consumption class according to the system customary within the European Union compared with the exhaust air dryer providing the basis, would be possible. In this connection it can thus be foreseen that the separating-out of a maximum amount of moisture in the heat exchanger arrangement is to be aimed for. To improve an energy consumption class from C for the simple exhaust air dryer to B for the exhaust air dryer with heat recovery it may be sufficient to aim to separate out not more than 10 grams of condensate per minute. Thereby the problem of storing a substantial volume of condensate as in the condensation dryer does not arise. It would furthermore also be conceivable to allow a blower of the dryer arranged downstream of the heat exchanger arrangement to continue to run after the conclusion of a drying process, in order to create an airstream for the evaporation of any remaining condensate. A small separate blower for this application would be conceivable. Finally, depending on the design of the dryer, a draft of air could also be used to evaporate possible residual condensate arising in the unused dryer, for example as a result of a flue effect. During operation, the drying chamber in particular must be sealed off from the environment of the dryer, in order to enable an undisturbed flow of process air, as provided for. To this end, the drying chamber is closed off by means of a suitable door. When not in use in such a manner, this door is as a rule open and thus also opens the process air duct to the environment of the dryer. A draft of air, building up through the process air duct including the secondary duct and the open doors, can effectively assist the evaporation of condensate remaining in the secondary duct.

In a preferred embodiment of the inventive dryer, the main duct is connected to the exhaust opening downstream of the heat exchanger arrangement, and the process air duct is connected to the inlet air opening upstream of the heat exchanger arrangement.

In this way the inventive dryer, in which basically an at least partial circulation of the process air is not excluded, is ideally suited as an exhaust air dryer.

The secondary duct is preferably embodied in such a way that it allows the diversion of a maximum of 50 vol. %, preferably 20 to 40 vol. %, particularly preferably 25 to 35 vol. % of a process air stream in the process air duct after exit from the drying chamber.

A body with a large surface area which can soak up the condensate is preferably present in the evaporation channel, for example a fleece, with which the secondary duct is lined.

The heat exchanger arrangement in the inventive dryer preferably has an evaporator and a condenser on a heat pump circuit which is known per se, where such a heat pump circuit is designed according to the compressor-heat pump principle. In a dryer equipped with such a heat pump, the cooling of the warm, moisture-laden process air essentially takes place in the evaporator of the heat pump, where the transferred heat is used for the evaporation of a coolant used in the heat pump circuit. The coolant of the heat pump, evaporated as a result of the heating is fed via a compressor to the condenser of the heat pump, where heat is released due to the condensing of the gaseous coolant, which is used to heat up the process air. The coolant circulates in a closed circuit, in which it passes from the condenser via a throttle valve back to the evaporator. In principle, any heat pump can be used. One advantage of the heat pump lies in the fact that the temperature levels for cooling or heating up the process air can be selected with a degree of independence from each other, whereby under certain circumstances the energy balance of the dryer can be further improved; the additional device-related effort is, though, considerable.

In a preferred embodiment of the inventive dryer with a heat pump, the condenser of the heat pump is located in the process air duct between the blower and the heater or between the blower and the inlet air opening.

Likewise preferable is the heat exchanger arrangement featuring a single heat exchanger, in particular an air-to-air heat exchanger, in which the moist hot process air from the drying chamber (drum) is used to heat supply air, which is then in turn fed into the drying chamber.

Particularly preferable is an embodiment of the dryer in which the secondary duct is set up for the storage of condensate. It is here assumed that the absorption capacity of the process air flowing through the secondary duct during operation of the dryer is not always at the same level for additional moisture. At the start of the drying process, when the items to be dried must first heat up, the process air stream in the drying chamber still absorbs little moisture, and can thus take up condensate still remaining from a previous drying process, and carry it away. In the middle of the drying process, the process air stream carries off a relatively large amount of moisture from the items to be dried, and can thus take up little condensate; it is thus advantageous if condensate that cannot be immediately evaporated can initially remain stored. Towards the end of a drying process, when the items to be dried have already given off a relatively large amount of moisture, the process air stream becomes drier once again and at the same time warmer, and can thus once again absorb and carry off condensate. If not all the condensate can here be evaporated, a certain amount can remain stored until a subsequent drying process or can be separately evaporated, as described above.

The subject of the invention is further a method for operating a dryer with a drying chamber for the items to be dried and a process air duct, in which are located a heater for the heating of process air and a blower for forcing the process air from the heater through the drying chamber and a heat exchanger arrangement, by means of which heat exchanger arrangement heat is removed from the process air flowing from the drying chamber and fed to the process air flowing to the heater, where process air is drawn in from an environment of the dryer into the process air duct through an inlet air opening and expelled into the environment of the dryer through an exhaust opening, where according to the invention the process air between the drying chamber and the heat exchanger arrangement is split between a main duct and a secondary duct, where the main duct directs a first process air stream to the heat exchanger arrangement and the secondary duct directs a second process air stream past the heat exchanger arrangement to a evaporator, where condensate which has been separated out of the first process air stream in the heat exchanger arrangement is evaporated into the second process air stream, and to the exhaust opening.

In the inventive method, the first process air stream preferably amounts to a maximum of 50 vol. %, particularly preferably 20 to 40 vol. % and the second subsidiary stream of process air at least 50 vol. %, particularly preferably 60 to 80 vol. % of the process air stream before the split, that is to say after exit from the drying chamber.

The cooled process air leaving the heat exchanger arrangement can be heated once more and directed into the drying chamber again. Alternatively, the cooled process air can be directed out of the dryer as exhaust air via an exhaust. In this case the process air directed into the drying chamber comprises exclusively heated supply air. The heating of the supply air here takes place at least partially by means of heat exchange with the process air from the dryer and/or with the coolant in the condenser of a heat pump.

According to the invention it is preferable if process air, supply air and/or coolant in the heat pump are in each case directed through the corresponding heat exchanger in a cross-flow or counterflow mode.

As with progression of the drying of the items to be dried in the condensation dryer, less energy is required for drying purposes, it is expedient to regulate the heater accordingly, that is to reduce its heating output as the degree of drying increases.

The inventive dryer has the advantage, that it is in a better energy efficiency class than an equivalent dryer without heat recovery, and condensate accruing can be conveyed to the outside without the need for a collection container requiring emptying or a pump, solely through its expulsion by means of process air.

BRIEF DESCRIPTION OF THE DRAWINGS

Further details of the invention are evident from the following description of preferred, non-restrictive exemplary embodiments for the dryer and method used for operation of the dryer. Wherein individually.

DETAILED DESCRIPTION OF EXEMPLARY EMBODIMENTS OF THE PRESENT INVENTION

Figure 1:
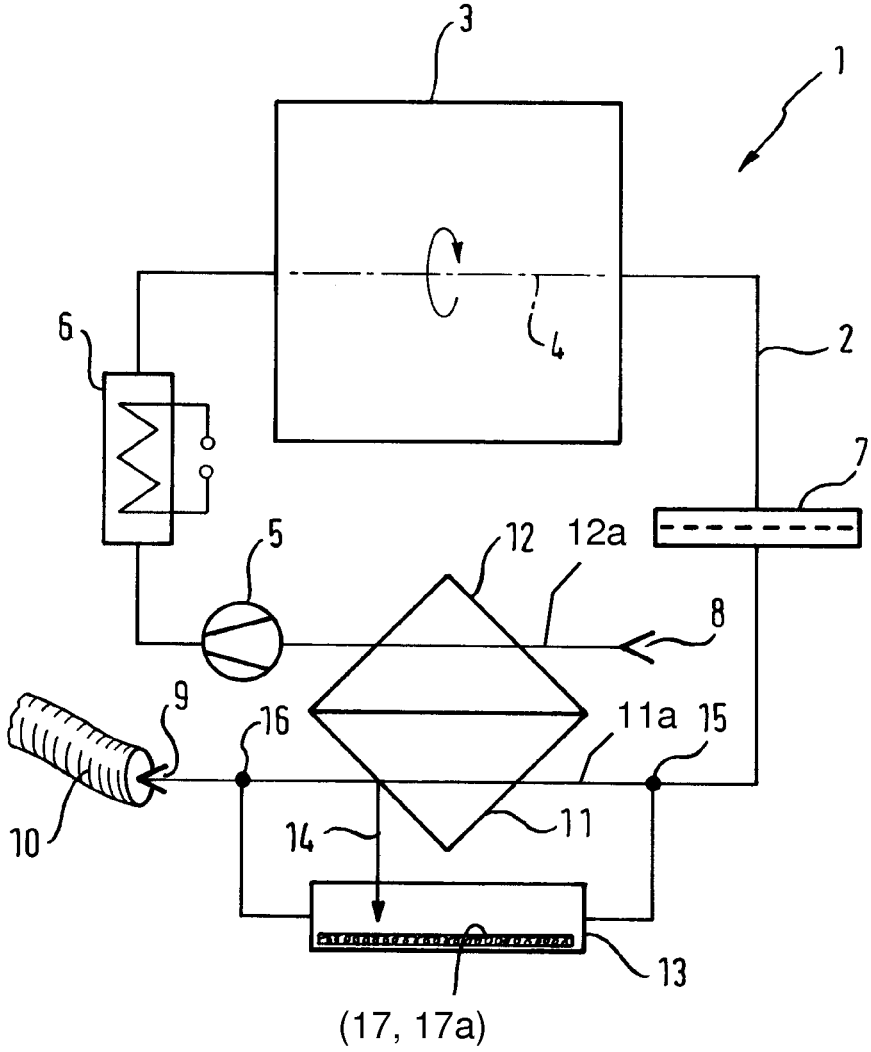
FIG. 1 shows a sketch of a first exemplary embodiment of a dryer with heat recovery.

The dryer 1 represented in FIG. 1 in sketch form has a process air duct 2 and a drying chamber 3, which is a drum 3 rotatable about an axis 4. Process air is directed via a heater 6 through the drum 3 and a lint filter 7 by means of a blower 5.

The process air is drawn in through an inlet air opening 8 and expelled through an exhaust opening 9. Air directly from an environment of the dryer 1 reaches the inlet air opening 8. Connected to the exhaust opening 9 is an exhaust air hose 10, with which the exhaust air is conveyed from the dryer 1 and out of a room in which it is set up. Also present is a heat exchanger arrangement 11, 12; in this or the corresponding entry channel 12, heat is transferred to the process air drawn in through the inlet air opening 8 from the process air flowing from the drum 3 and the lint filter 7. After passing through the drum 3, the moist, warm process air is cooled down; the process air to be directed to the heater, on the other hand, is preheated. The process air completely heated by the heater 6 is directed into the drum 3, there comes into contact with the laundry to be dried and flows thereafter to the lint filter 7. The process air stream then splits into two; a main portion reaches the main duct 11, which leads through the heat exchanger 11, 12, where it gives off heat to freshly drawn-in supply air, which flows through the entry channel 12*a* of the heat exchanger arrangement 11, 12. As already mentioned, the amount of heat thereby transferred must be measured on the basis of a concrete value prescribed in advance in relation to the energy balance of the dryer 1, and need not necessarily correspond to the full amount of heat available in the main duct 11*a*. One finding derived herefrom is that it is not necessary to call upon the full process air stream emerging from the drum 3 for heat exchange purposes. It is thus possible to use part of the process air stream, in order to dispose of condensate accruing upon cooling of the process air in the main duct 11*a*. To this end a secondary duct 13 is provided, in which a corresponding portion of the process air is directed past the heat exchanger arrangement 11, 12. Condensate accruing in the main duct 11*a* reaches the secondary duct 13 through a corresponding channel 14. A natural gradient, which can be formed by means of appropriate construction of the main duct 11*a* and an arrangement of the secondary duct 13 under the main duct 11*a* is expediently employed to transport the condensate. The first junction 15 in the process air duct 2, at which the process air stream splits into a first process air stream to the main duct 11*a* and a second process air stream to the secondary duct 13, is so designed that the second process air stream comprises some 30% of the entire available process air. In the secondary duct 13, the second process air stream absorbs the evaporated condensate and rejoins the first process air stream at the second junction 16. An evaporator 17 in the form of a fleece 17*a* is embodied in the secondary duct 13; the fleece 17*a* soaks up the condensate and, assisted by its relatively large surface area, gives it off to the second process air stream flowing past.

Figure 2:
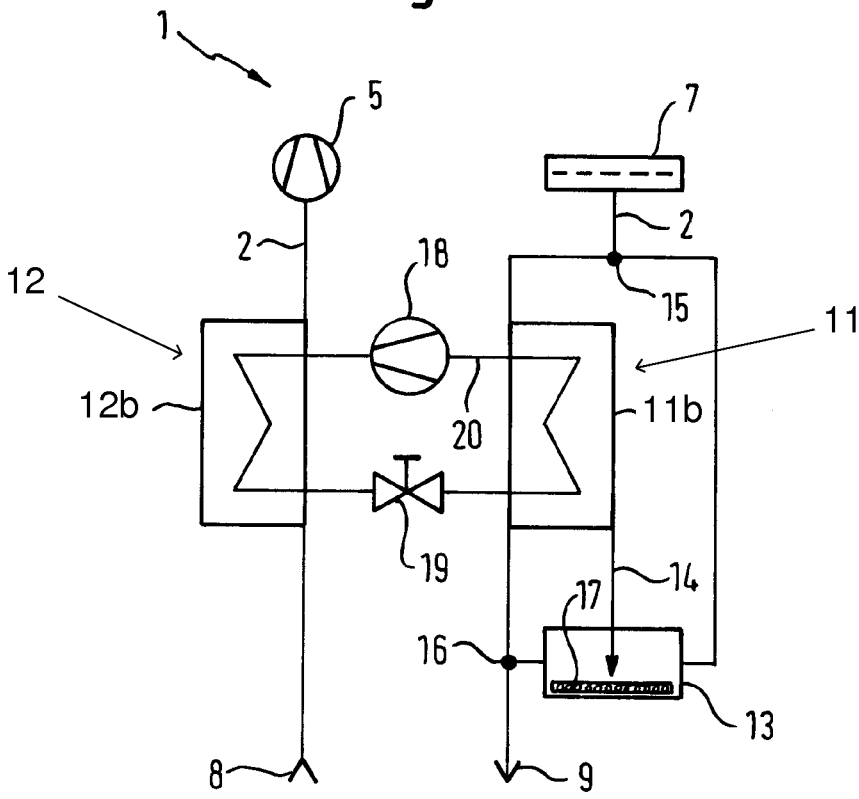
FIG. 2 shows a sketch of a second exemplary embodiment of a dryer with heat recovery.

FIG. 2 shows a second exemplary embodiment, though the components of the dryer 1 above the blower 5 and the lint filter 7 are not shown; they correspond to the components according to FIG. 1.

The major difference to the exemplary embodiment according to FIG. 1 is that the heat exchanger arrangement 11, 12 does not comprise a simple counterflow or crossflow heat exchanger 11, 12, but is formed by an evaporator 11*b* (main duct) and a condenser 12*b* (entry channel) of a heat pump 11*b*, 12*b*, 18, 19, 20, which additionally has a compressor 18, a throttle valve 19 and a pipeline 20 for a coolant to be conveyed in a circuit and coolant which is to be evaporated, compressed, liquefied and expanded on a cyclical basis. The evaporator 11*b* and the condenser 12*b* of FIG. 2 function in the same way as the main duct 11*a* and the secondary duct 13 as in the dryer 1 of the exemplary embodiment according to FIG. 1, but the heat pump 11*b*, 12*b*, 18, 19, 20 allows greater freedom in the setting of the temperature level in the evaporator 11*b* (main duct) and in the condenser 12*b* (entry channel), thus offering further options for optimizing the energy balance of the dryer 1.

Even if the exemplary embodiments of the invention show exhaust air dryers, it should be borne in mind that the invention is not limited to exhaust air dryers, but also in particular includes such dryers as partially circulate process air. Whatever the circumstances, an inventive dryer anyway permits the partial recovery of heat energy which is otherwise lost to the drying process. To this end a heat pump can, but need not necessarily be employed. Use of the invention in particular, but not exclusively, in an exhaust air dryer is accordingly also attractive from the economic standpoint.

The invention claimed is:

1. A dryer comprising:

a drying chamber, the drying chamber retaining items to be dried;

a process air duct;

a heater located in the process air duct, the heater being operable to heat process air;

a heat exchanger arrangement; and a blower located in the process air duct, the blower being operable to advance process air from the heater through the drying chamber and thereafter through the heat exchanger arrangement, the heat exchanger arrangement being operable to remove heat from process air flowing from the drying chamber and to transfer the heat to process air flowing to the heater, the process air duct having an inlet air opening for drawing in process air from the surrounding environment in which the dryer is located and an exhaust opening for the expulsion of process air into the surrounding environment, and the process air duct being divided, at a dividing location between the drying chamber and the heat exchanger arrangement, into a main duct and a secondary duct, the main duct extending from the dividing location to the heat exchanger arrangement and conveying a first part of the process air flowing from the drying chamber to the heat exchanger, and the secondary duct extending from the dividing location along a path that bypasses the heat exchanger arrangement, the secondary duct having an evaporator and being communicated with the exhaust opening, the secondary duct conveying a second part of the process air flowing from the drying chamber to the evaporator, the evaporator being operable to evaporate condensate, which has been separated out from the first part of the process air in the heat exchanger arrangement, into the second part of the process air flowing to the exhaust opening.

2. The dryer as claimed in claim 1, wherein the main duct is connected to the exhaust opening downstream of the heat exchanger arrangement and the process air duct is connected to the inlet air opening upstream of the heat exchanger arrangement.

3. The dryer as claimed in claim 1, wherein the secondary duct is configured to receive a diversion of process air up to a maximum of fifty percent (50%) of a volume of a process air stream in the process air duct after the process air stream has exited from the drying chamber.

4. The dryer as claimed in claim 3, wherein the secondary duct is configured to receive a diversion of process air between about twenty percent (20%) to about forty percent (40%) of the volume of the process air stream in the process air duct after the process air stream has exited from the drying chamber.

5. The dryer as claimed in claim 1, wherein the evaporator comprises a body with a surface area available to soak up condensate.

6. The dryer as claimed in claim 5, wherein the body comprises a fleece body.

7. The dryer as claimed in claim 1, wherein the heat exchanger arrangement comprises an evaporator and a condenser of a heat pump circuit.

8. The dryer as claimed in claim 1, wherein the heat exchanger arrangement is a single heat exchanger.

9. The dryer as claimed in claim 1, wherein the secondary duct is configured for storage of condensate.

10. A method for the operation of a dryer with a drying chamber for items to be dried and a process air duct, the method comprising:

through an inlet air opening of a process air duct, drawing in process air from a surrounding environment in which the dryer is located;

through an exhaust opening of the process air duct, expelling process air out of the dryer into the surrounding environment after the process air has been guided through the dryer;

advancing process air through the process air duct via a blower;

heating process air via a heater in the process air duct;

advancing process air that has been heated via the heater through the drying chamber and thereafter from the drying chamber to a heat exchanger arrangement;

removing heat from process air at the heat exchanger arrangement;

transferring the heat removed from process air at the heat exchanger arrangement to process air being advanced to the drying chamber;

at a dividing location, dividing process air that has passed through the drying chamber into a first flow through a main duct and a second flow through a secondary duct with the first flow of process air through the main duct being guided by the main duct to the heat exchanger arrangement and the second flow of process air through the secondary duct bypassing the heat exchanger arrangement; and via an evaporator in the secondary duct, evaporating condensate, which has been separated out of the first flow of process air in the main duct, into the second flow of process air through the secondary duct; and advancing process air from the secondary duct to the exhaust opening.

11. The method as claimed in claim 10, wherein the dividing process air that has passed through the drying chamber into the first flow through the main duct and the second flow through the secondary duct includes diverting into the secondary duct between about twenty percent (20%) to about forty percent (40%) of a volume of a process air stream in the process air duct after the process air stream has exited from the drying chamber.

* * * * *

UNITED STATES PATENT AND TRADEMARK OFFICE

CERTIFICATE OF CORRECTION

PATENT NO. : 8,438,751 B2
APPLICATION NO. : 12/528499
DATED : May 14, 2013
INVENTOR(S) : Andreas Stolze It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 933 days.

Signed and Sealed this
Eighth Day of September, 2015

Michelle K. Lee

Michelle K. Lee
*Director of the United States Patent and Trademark Office*